US007021364B2

(12) United States Patent
Park et al.

(10) Patent No.: US 7,021,364 B2
(45) Date of Patent: Apr. 4, 2006

(54) APPARATUS FOR PREVENTING THE CONTAMINATION OF CASTING ROLLS AND BULGING OF STRIP IN A TWIN ROLL STRIP CASTER

(75) Inventors: Cheol-Min Park, Pohang-si (KR); Dong-Kyun Choo, Pohang-si (KR); Tae-Wook Kang, Pohang-si (KR)

(73) Assignees: POSCO, (KR); Research Institute of Industrial Science and Technology, (KR)

( * ) Notice: Subject to any disclaimer, the term of this patent is extended or adjusted under 35 U.S.C. 154(b) by 0 days.

(21) Appl. No.: 10/489,232

(22) PCT Filed: Dec. 20, 2002

(86) PCT No.: PCT/KR02/02397

§ 371 (c)(1),
(2), (4) Date: Mar. 10, 2004

(87) PCT Pub. No.: WO03/055625

PCT Pub. Date: Jul. 10, 2003

(65) Prior Publication Data

US 2004/0251583 A1 Dec. 16, 2004

(30) Foreign Application Priority Data

Dec. 21, 2001 (KR) ..... 10-2001-0082306

(51) Int. Cl.
*B22D 11/06* (2006.01)

(52) U.S. Cl. ..... 164/428; 164/415

(58) Field of Classification Search ..... 164/479–480, 164/427–429, 475, 415
See application file for complete search history.

(56) References Cited

U.S. PATENT DOCUMENTS

| | | | | |
|---|---|---|---|---|
| 5,103,895 | A | 4/1992 | Furuya et al. | |
| 5,368,088 | A | 11/1994 | Furuya et al. | |
| 5,590,701 | A * | 1/1997 | Fukase | 164/415 |
| 5,651,413 | A | 7/1997 | Williams et al. | |
| 5,660,224 | A | 8/1997 | Barbe et al. | |

FOREIGN PATENT DOCUMENTS

| | | | |
|---|---|---|---|
| JP | 06-297111 | A | 10/1994 |
| JP | 07-204795 | A | 8/1995 |
| WO | WO 93/22087 | * | 11/1993 |

* cited by examiner

*Primary Examiner*—Kuang Y. Lin
(74) *Attorney, Agent, or Firm*—The Webb Law Firm

(57) ABSTRACT

An apparatus for preventing bulging of both edges of a strip while preventing contamination of a roll surface in a twin roll strip caster including a meniscus shield (5) and a plurality of weirs (12). The apparatus comprises: first chambers (60) arranged at both sides of the meniscus shield (5) in a longitudinal direction parallel to the casting roll (1) and having inlet and outlet ports for non-oxidizing gas; second chambers (80) each assembled to an underside in each of the first chambers (60) in a communicating fashion for receiving non-oxidizing gas from the first chambers (60), and including a plurality of holes (81) formed in an inclined face thereof corresponding to an outer peripheral face in each of the casting rolls (1 and 1*a*) in a longitudinal direction of the each casting roll (1 or 1*a*); and passages S formed between the meniscus shield (5) and the second chambers (80) and reaching the gas outlet ports of the first chambers for allowing contaminated gas containing evaporated metal components and non-oxidizing gas injected from the second chambers (80) to be outwardly exhausted.

9 Claims, 8 Drawing Sheets

APPARATUS FOR PREVENTING THE CONTAMINATION OF CASTING ROLLS AND BULGING OF STRIP IN A TWIN ROLL STRIP CASTER

BACKGROUND OF THE INVENTION

1. Field of the Invention

The present invention relates to an apparatus for preventing bulging of both edges of a strip while preventing contamination of a roll surface in a twin roll strip caster. More particularly, the apparatus of the invention mutually adjusts gas pressure in a first space between weirs for preventing molten level fluctuation and gas pressure in second spaces outside the weirs where rolls contact with molten steel so that metal components evaporated from a surface of molten steel may not stick to roll edges, and outwardly exhausts the metal components evaporated in the second spaces mainly through a central portion rather than through edge portions in respect to a roll lateral direction so as to realize a defectless strip through uniform condensation in the roll lateral direction.

2. Description of the Prior Art

As shown in FIG. 1, a conventional twin roll caster 100 feeds molten steel from a tundish 2 through an immersion nozzle 3 into a space between dams 4 closely contacted to both sides of casting rolls 1 and 1*a* so that a molten iron pool 13 is formed by the casting rolls 1 and 1*a* and the edge dams 4. A meniscus shield 5 is installed over the casting rolls 1 and 1*a* to prevent oxidation of molten steel owing to oxygen contained in air contacting with a surface of the molten iron pool 13, and non-oxidizing gas is fed into a hollow space between an underside of the meniscus shield 5 and the surface of the molten steel pool 13. As a result, the surface of the molten steel pool 13 contacts with non-oxidizing gas thereby restraining oxidation of molten metal by the maximum amount.

Japanese Laid-Open Patent Application Ser. No. H6-297111 proposes a sealing apparatus, which is arranged over molten steel level to adjust the depth of the immersion nozzle 3 immersed into molten steel while shielding the molten steel pool 13 surrounded by the casting rolls 1 and 1*a* and the edge dams 4 from an external oxidizing atmosphere in order to prevent oxidation of molten steel in the molten steel pool 13.

According to the above document, where it is necessary to vary molten steel level during casting, adjustment of a spring mounted on a lateral portion of the tundish can regulate the immersed depth of the immersion nozzle 3 while successively maintaining the atmosphere over the molten steel surface.

Furthermore, a Japanese Laid-Open Patent Application Ser. No. H7-204795 is aimed to install side dams or weirs which are partially immersed into the molten steel pool 13 so as to prevent oxide created in the molten steel surface from flowing into a solidification cell mixed with molten steel. That is, this technology sets a certain gap between each of the casting rolls 1 and 1*a* and each of the side dams and maintains the molten steel level within this gap and a space over molten steel in a non-oxidizing gas atmosphere so as to prevent creation of oxide by the maximum amount as well as created oxide from flowing into the growing solidification cell mixed with molten steel.

However, even though the non-oxidizing atmosphere gas is filled over the molten steel surface, volatile components such as Mn, Zn and Pb escapes from the molten steel pool 13 into the atmosphere gas so as to mix with pure non-oxidizing gas thereby creating contaminated gas.

Since contaminated gas contains the above-mentioned volatile components, it is condensed in contact with cold surfaces of the casting rolls 1 and 1*a* and thus sticks thereto to influence heat transmission of the casting rolls 1 and 1*a* thereby deteriorating the quality of a strip 10. In order to avoid this problem, it is necessary to avoid the surfaces of the casting rolls 1 and 1*a* from contacting with contaminated gas if possible.

Furthermore, since this technology has no means for controlling the flow of volatile metal gas created from the molten steel surface, such volatile metal gas or contaminated gas contaminates the surfaces of the casting rolls 1 and 1*a* thereby causing surface defects of the strip 10 as well as degrading productivity.

Gas pipes 6 are installed at both sides of the meniscus shield 5 parallel to the longitudinal direction of the rolls and connected to a gas feeding line 9 for feeding non-oxidizing gas to block external gas from flowing into a lower space of the meniscus shield 5. A second flow of non-oxidizing gas such as nitrogen is also injected toward outer peripheral faces of the rolls to prevent external air from flowing into the lower space of the meniscus shield as well as assist the above-mentioned flow of non-oxidizing gas.

Molten steel dispensed via a nozzle hole 14 in a lower end of the immersion nozzle 3 may create molten level fluctuations since the flowing molten steel has a very large amount of momentum. In order to regulate molten steel fluctuation in the molten steel pool 13, weirs 12 are installed along a longitudinal direction of the rolls with their upper ends fixed to weir supports 17, see FIG. 2.

Although it is most preferred to maintain the non-oxidizing atmosphere in the space over the surface of the molten steel pool 13, the space is rarelyprovided with perfect sealing and oxide is partially produced in the surface of the molten steel. The weirs 12 act as barriers to prevent the above-produced oxide from reaching the growing solidification cell.

In the molten steel pool 13 formed between the casting rolls 1 and 1*a*, specific substances such as Mn continuously evaporate from the surface of molten steel in the lower space of the meniscus shield 5, and the above-mentioned metal components or volatile impurities mix with non-oxidizing gas fed onto the molten steel surface moving along the non-oxidizing gas flow.

Since the volatilized substances such as Mn have a very low value of thermal conductivity, they may function as a thermal resistance when deposited on the surfaces of the casting rolls 1 and 1*a* in formation of a solidified cell 11, thereby creating regional bulging owing to non-solidification and resultant defects of the strip 10.

Natural exhaustion is generally made in the space under the meniscus shield 5. However, when contaminated gas is produced exceeding a reference quantity, it is necessary to actuate a gas exhaust hose 8 via an exhaust pump 7 to adjust the quantity of gas which is exhausted to the outside.

As shown in FIG. 2, the flow of non-oxidizing gas is produced via a gap between the edge dam 4 and the weir 12. When the gap between the weir 12 and the edge dam 4 is removed to clear the flow of non-oxidizing gas, that is, the weir 12 closely contacts with the edge dam 4, skull is created in a contacting region between the edge dam 4 and the weir 12 so that the weir 12 may be damaged in some hostile situations thereby suspending casting.

Further, the edge dam 4 is sometimes vibrated in order to restrain skull creation on a surface of the edge dam 4.

However, if the weir 12 is closely contacted with the edge dam 4, vibration acting on the edge dam 4 may damage the weir 12. Accordingly, it is not preferred to closely contact the edge dam 4 with the weir 12.

As set forth above, non-oxidizing gas externally supplied into the meniscus shield 5 is contaminated through mixture with the evaporated metal components from the molten steel pool 13 while flowing through the meniscus shield 5. When mixed gas or contaminated gas contacts with the surfaces of the casting rolls 1 and 1*a*, the evaporated metal components are condensed into solid again to stick to the surfaces of the casting rolls 1 and 1*a*.

The evaporated solid components stuck to the casting rolls 1 and 1*a* obstruct heat transmission of the casting rolls 1 and 1*a* and thus vary the thickness of the adjacent solidification cell 11, thereby causing cracks in solidification of a cast strip. As a result, it is necessary to manage the casting rolls 1 and 1*a* in such a manner that contaminated gas does not stick to the surfaces of the casting rolls 1 and 1*a*.

The present invention is intended to solve the foregoing problems of the prior art by providing an apparatus for preventing bulging of both edges of a strip while preventing contamination of a roll surface in a twin roll strip caster, which prevents contaminated gas formed through mixture of non-oxidizing gas and the evaporated metal components from contacting and sticking to the roll surfaces or mixing into molten steel.

SUMMARY OF THE INVENTION

It is an object of the present invention to provide an apparatus for preventing contamination of roll surface and strip edge bulging in a twin roll strip caster which includes a meniscus shield 5 for interrupting inflow of external air while feeding non-oxidizing gas to prevent oxidation of molten steel in a molten steel pool 13 defined by casting rolls 1 and 1*a* and edge dams 4 and a plurality of weirs 12 mounted under the meniscus shield 5 for preventing mold level fluctuation, the apparatus comprising: first chambers 60 arranged at both sides of the meniscus shield 5 in a longitudinal direction parallel to the casting roll 1 and having inlet and outlet ports for non-oxidizing gas; second chambers 80 each assembled to an underside in each of the first chambers 60 in a communicating fashion for receiving non-oxidizing gas from the first chambers 60, and including a plurality of holes 81 formed in an inclined face thereof corresponding to an outer peripheral face in each of the casting rolls 1 and 1*a* in a longitudinal direction of the each casting roll 1 or 1*a*; and passages S formed between the meniscus shield 5 and the second chambers 80 and reaching the gas outlet ports of the first chambers for allowing contaminated gas containing evaporated metal components and non-oxidizing gas injected from the second chambers 80 to be outwardly exhausted.

DETAILED DESCRIPTION OF THE INVENTION

The following detailed description will present a preferred embodiment of the invention in reference to the accompanying drawings.

Figure 3:
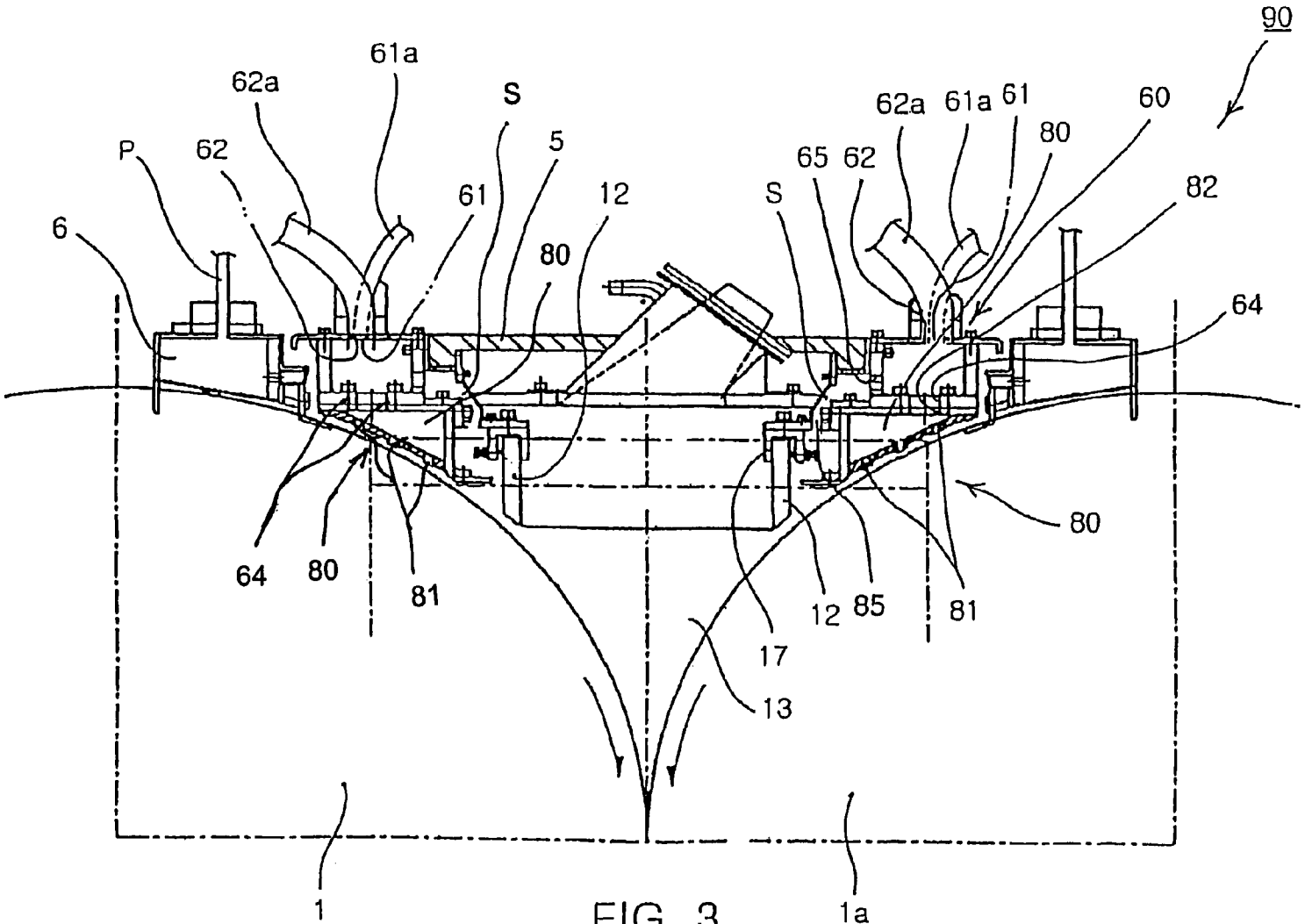
FIG. 3 is a sectional view illustrating an apparatus for preventing surface contamination of casting rolls and bulging of a strip in a twin roll strip caster of the invention.
Figure 4:
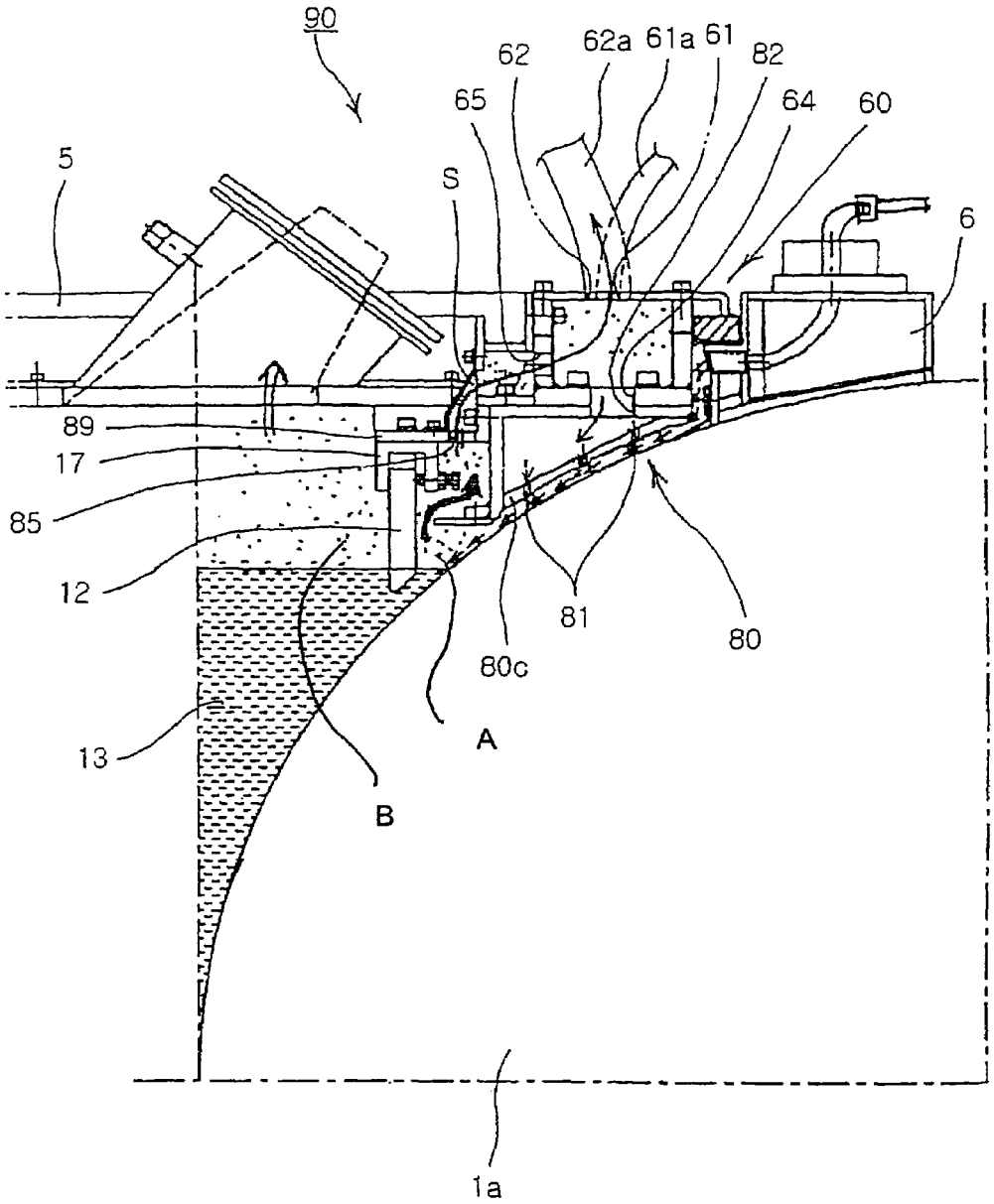
FIG. 4 is a partial sectional view illustrating an apparatus for preventing surface contamination of casting rolls and bulging of a strip in a twin roll strip caster of the invention.
Figure 5:
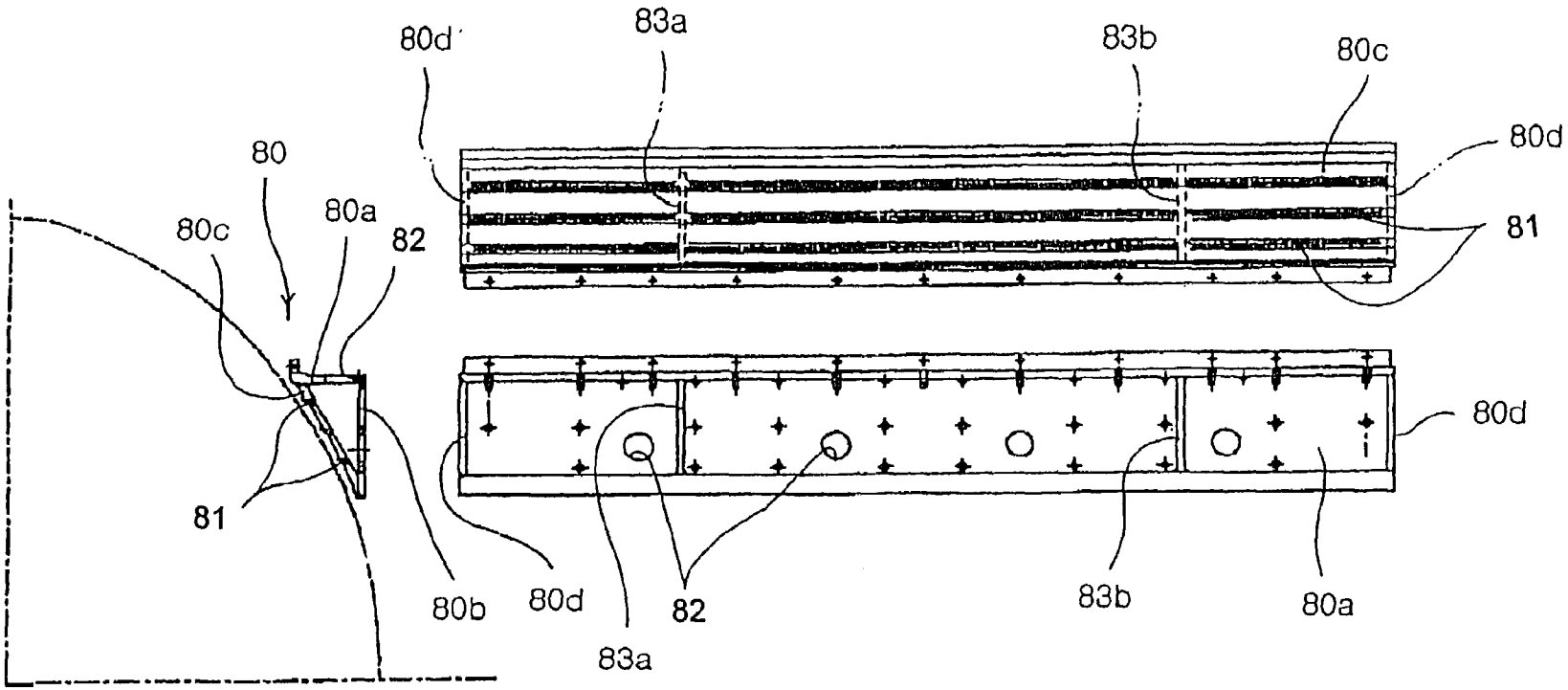
FIG. 5 is a detailed view illustrating a second chamber adopted in an apparatus for preventing surface contamination of casting rolls and bulging of a strip in a twin roll strip caster of the invention.
Figure 6:
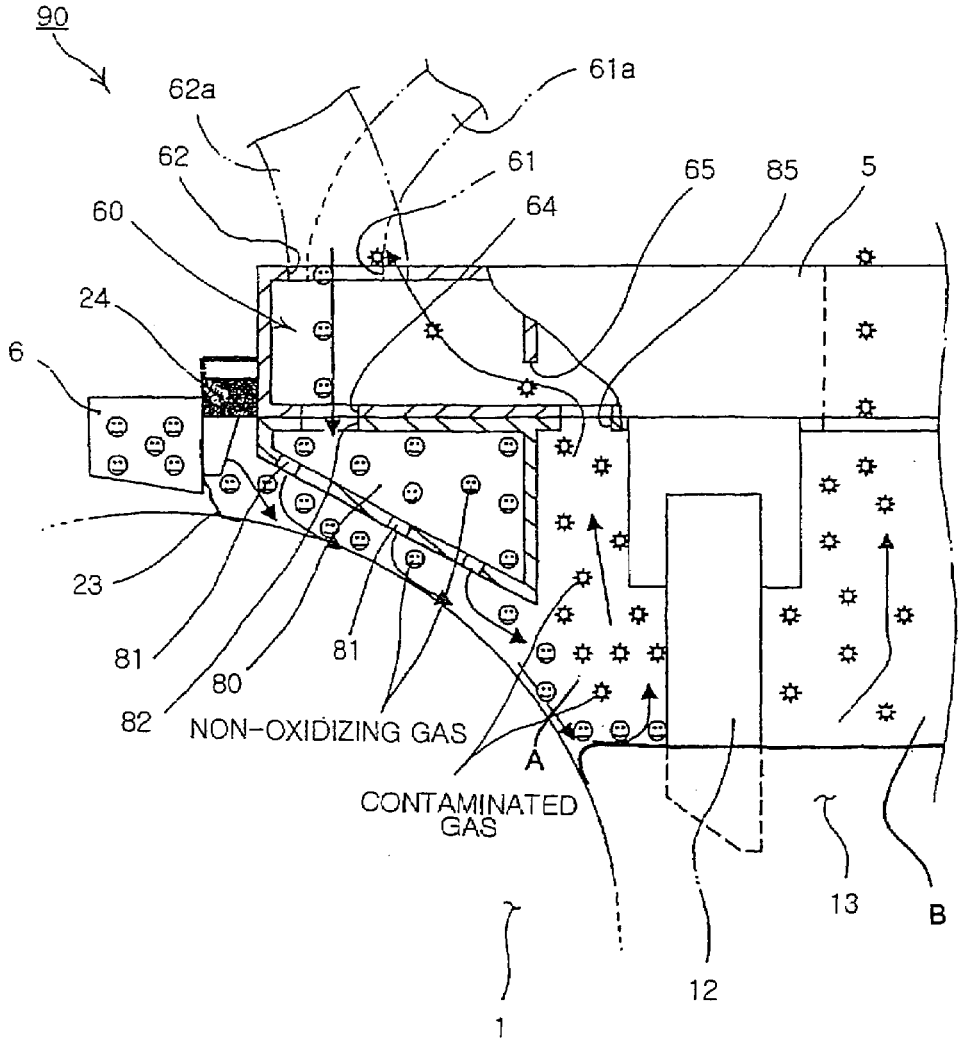
FIG. 6 is a conceptual view illustrating an apparatus for preventing surface contamination of casting rolls and bulging of a strip in a twin roll strip caster of the invention in use.
Figure 7:
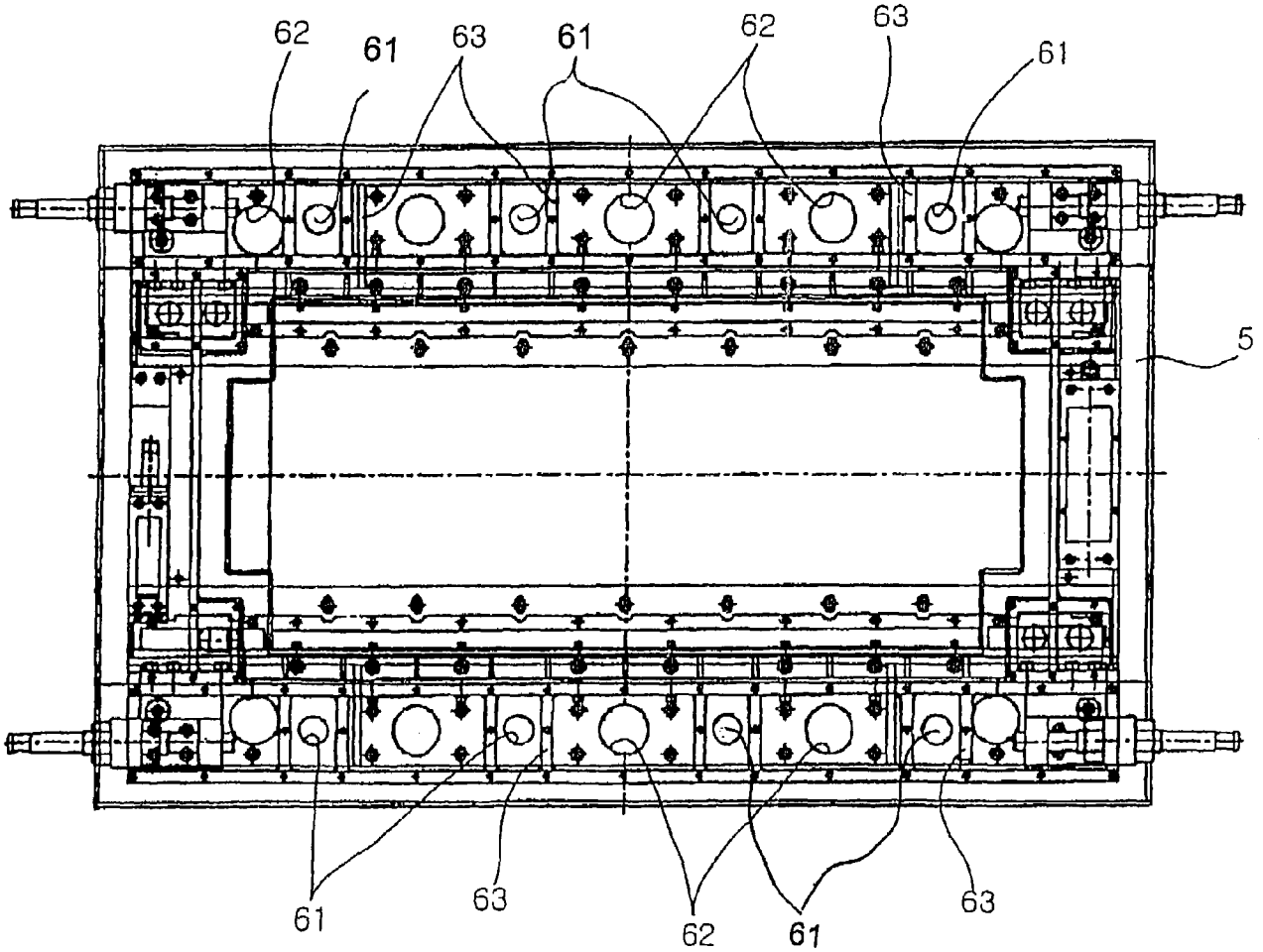
FIG. 7 is a plan view of a meniscus adopted in an apparatus for preventing surface contamination of casting rolls and bulging of a strip in a twin roll strip caster of the invention.
Figure 8:
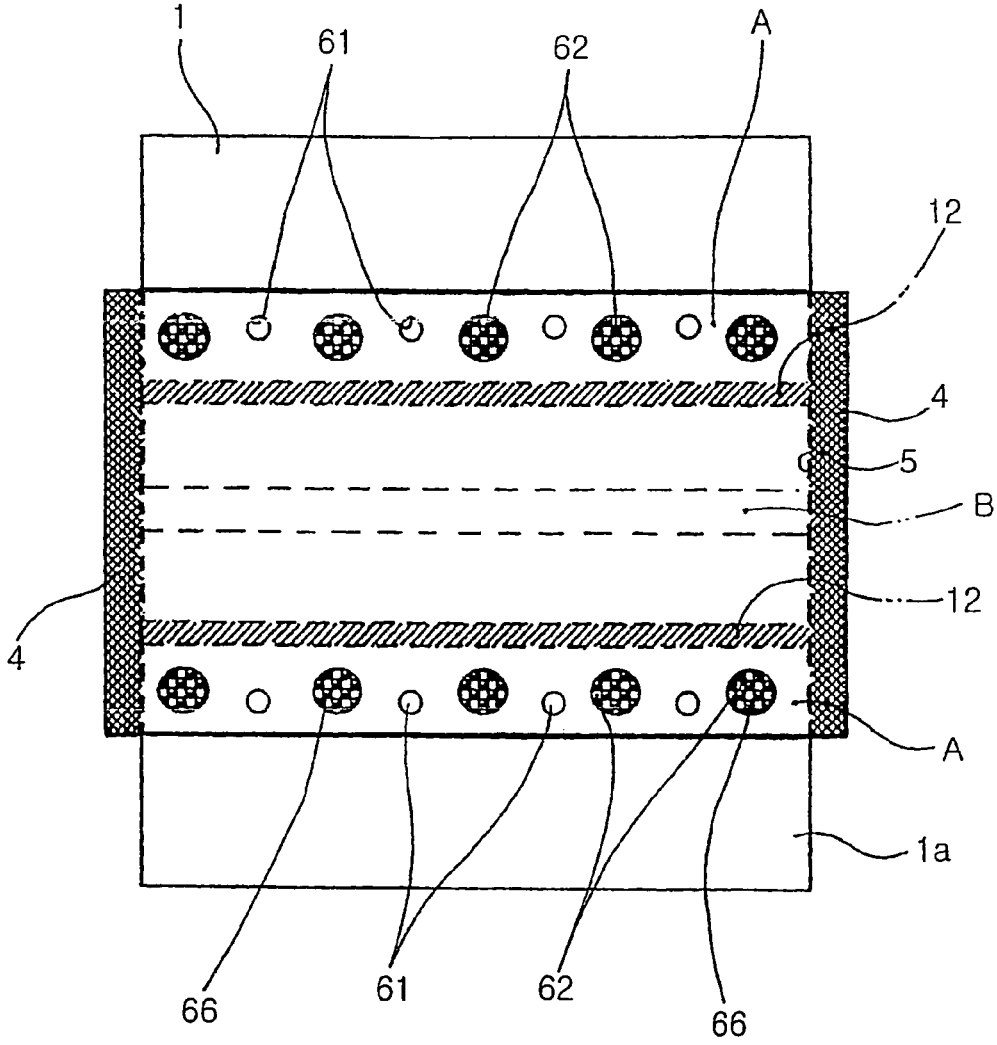
FIG. 8 is a perspective view illustrating first and second areas formed in an apparatus for preventing surface contamination of casting rolls and bulging of a strip in a twin roll strip caster of the invention.

FIG. 3 is a sectional view illustrating an apparatus for preventing surface contamination of casting rolls and bulging of a strip in a twin roll strip caster of the invention, FIG. 4 is a partial sectional view illustrating an apparatus for preventing surface contamination of casting rolls and bulging of a strip in a twin roll strip caster of the invention, FIG. 5 is a detailed view illustrating a second chamber adopted in an apparatus for preventing surface contamination of casting rolls and bulging of a strip in a twin roll strip caster of the invention, FIG. 6 is a conceptual view illustrating an apparatus for preventing surface contamination of casting rolls and bulging of a strip in a twin roll strip caster of the invention in use, FIG. 7 is a plan view of a meniscus adopted in an apparatus for preventing surface contamination of casting rolls and bulging of a strip in a twin roll strip caster of the invention, and FIG. 8 is a perspective view illustrating first and second areas formed in an apparatus for preventing surface contamination of casting rolls and bulging of a strip in a twin roll strip caster of the invention.

As shown in FIGS. 3 to 8, the apparatus 1 of the invention is installed in a longitudinal direction of casting rolls 1 and 1*a* at both sides of a meniscus shield 5 which covers an upper portion of a molten steel pool 13. The apparatus 1 of the invention comprises first chambers 60 and second chambers 80, and regulates the flow of non-oxidizing gas fed to outer peripheral faces of the casting rolls 1 and 1*a* so that contaminated gas created through mixture between metal components evaporated from molten steel and non-oxidizing gas does not contact with the casting rolls 1 and 1*a* so as to obtain uniform solidification of a strip.

That is, the first chambers 60 are arranged at both sides of the meniscus shield 5 in a longitudinal direction parallel to the casting rolls 1 and 1*a* for receiving non-oxidizing gas fed from an external gas pump. Each of the first chambers 60 has a plurality of plates assembled via bolts to define a box-shaped internal space allowing contaminated gas from the molten steel pool 13 to escape outside. In an upper portion, the each first chamber 60 has upper gas inlet ports 61 connected to a gas feed line 61*a* for feeding non-oxidizing gas and upper gas exhaust ports 62 connected to a gas exhaust line 62*a* for exhausting contaminated gas. The upper gas inlet ports 61 and outlet exhaust ports 62 are individually perforated in the upper portion of the each first chamber 60, separated via a plurality of partitions. The each first chamber 60 has lower gas outlet ports 64 perforated in an underside thereof communicating with to the upper gas inlet ports 61, and lower gas exhaust ports 65 perforated in a lateral portion thereof communicating with the upper gas exhaust ports 62. The lateral portion is opposed to each of the sides of the meniscus shield 5.

The gas feed line 61*a* extended from the upper gas inlet ports 61 of the each first chamber 60 is connected to the gas pump for feeding non-oxidizing gas and having a manometer capable of measuring feeding pressure and flow rate. The gas exhaust line 62*a* extended from the upper gas exhaust ports 62 communicates with an exhaust pump 7. The upper gas exhaust ports 62 are preferably provided with filter members 66 so as to clear foreign substances from contaminated gas outwardly exhausted from the each first chamber 60, see FIG. 8.

Each of the second chambers 80 is detachably assembled to the underside of the each first chamber 60 and communicates with the lower gas outlet ports 64 formed in the underside of the each first chamber 60 so as to receive non-oxidizing gas from the each first chamber 60. The each second chamber 80 includes a horizontal plate 80*a*, a vertical plate 80*b*, an inclined plate 80*c* and end plates 80*d* which are assembled to both ends of the plates 80*a*, 80*b* and 80*c* via a plurality of bolts to define a triangular internal space, see FIGS. 3–5. The each second chamber 80 has an inclined face corresponding to an outer peripheral face in each of the casting rolls 1 and 1*a* having a plurality of holes 81 formed in a longitudinal direction of the each casting roll 1 or 1*a* so that non-oxidizing gas internally fed via the lower gas outlet ports 64 can be injected to the outer peripheral face of the each casting roll 1 or 1*a*.

A plurality of gas inlet ports 82 are perforated in an upper face of the each second chamber 80 to communicate with the lower gas outlet ports 64 of the each first chamber 60. As depicted in FIGS. 5 and 6, two partitions 83*a* and 83*b* are installed in the internal space of the each second chamber 80 in order to divide flow of non-oxidizing gas into a central partial flow and lateral partial flows when non-oxidizing gas is injected toward the outer peripheral face of the each casting roll 1 or 1*a* via the holes 81.

Preferably, the inclined face of the each second chamber having the holes 81 is uniformly spaced from the outer peripheral face of the each casting roll 1 or 1*a* with a curvature substantially identical as the curvature of the roll surface in order to readily control gas flow.

Passages S are formed between the second chambers 80 and the both sides of the meniscus shield 5 so as to exhaust contaminated gas via the lower gas exhaust ports 65 in the lateral portions of the first chambers, in which contaminated gas is formed through the mixture of the metal components evaporated from molten steel and non-oxidizing gas injected from the holes 81 of the second chambers 80 toward the outer peripheral faces of the casting rolls 1 and 1*a*.

Preferably, the passages S, as perhaps best seen in FIG. 4 are defined by the spaces between weirs 12 and the second chambers 80, vent holes 85 perforated in fixing plates 89 for fixing the second chambers 80 and the gas exhaust lines for interconnecting the lower gas exhaust ports 65 of the first chambers 60.

With reference to FIG. 6, sealing members 24 block the open spaces between the first chambers 60 and gas knives 6. Curtains 23 are installed in portions of the gas knives 6 to block clearances between lower ends of the gas knives 6 and the casting rolls 1 and 1*a* so as to prevent inflow of external air. As a result, the casting rolls 1 and 1*a* are rotated during casting to block inflow of external air to a surface of the molten steel pool 13 while outwardly exhausting contaminated gas via the upper gas outlet ports 62 of the first chambers 60.

The sealing members 24 are generally made of wool, and the curtains 23 are made of steel foil.

Hereinafter, the operation and effect of the invention having the above construction will be described.

Figure 1:
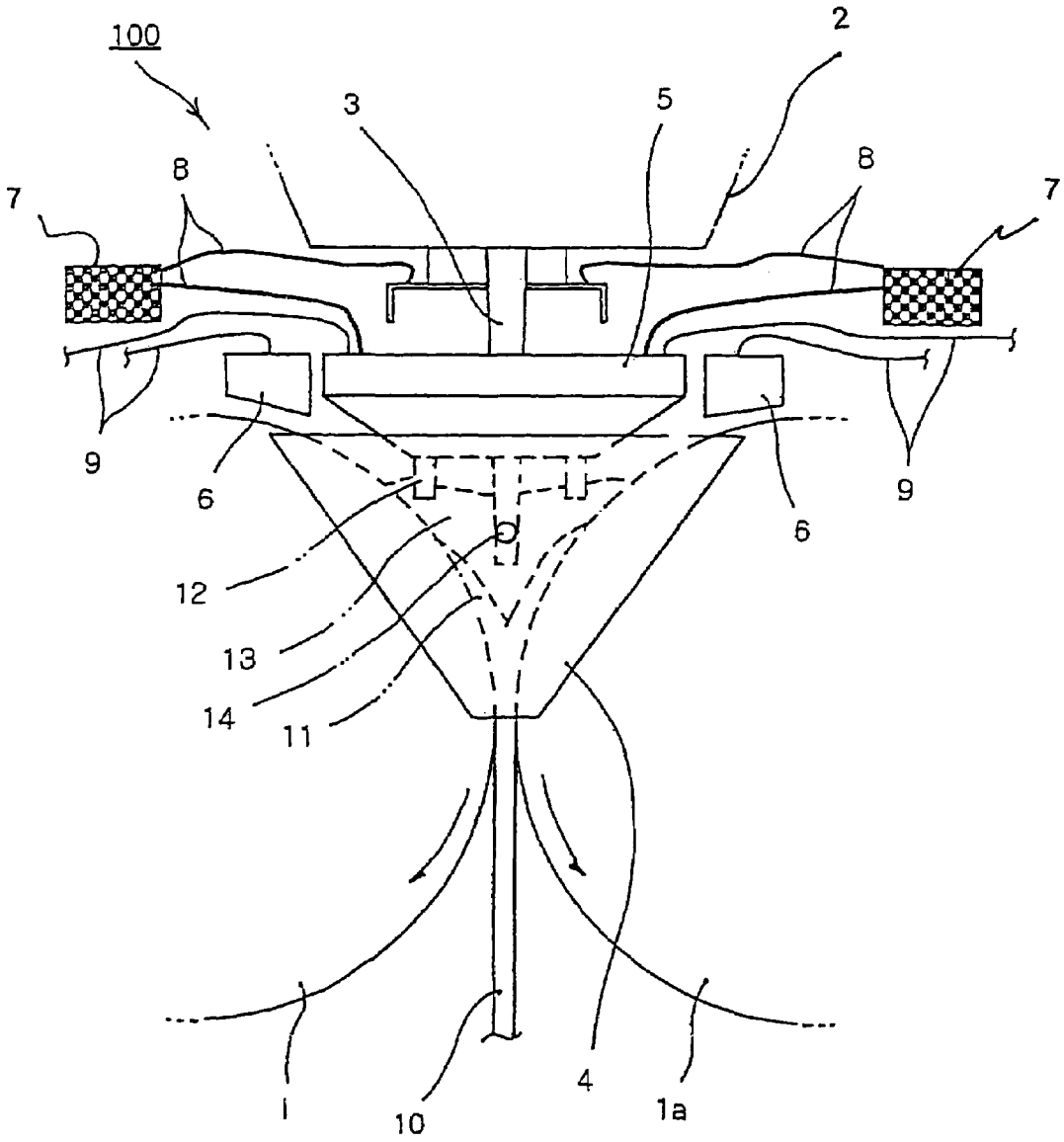
FIG. 1 PRIOR ART
FIG. 1 is a perspective view illustrating a conventional twin roll strip caster.
Figure 2:
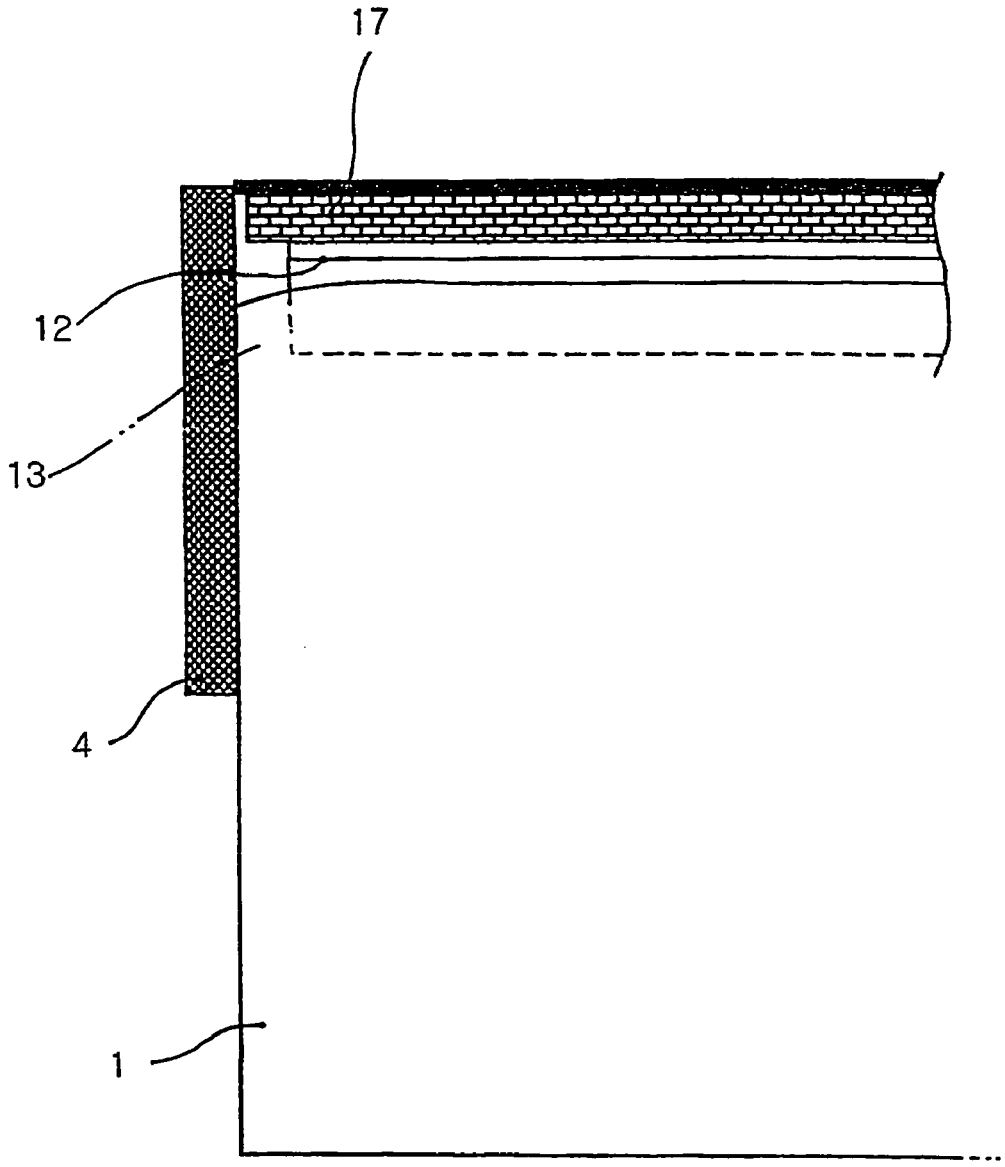
FIG. 2 PRIOR ART
FIG. 2 is a perspective view illustrating mounted positions of an edge dam and a weir in the twin roll strip caster in FIG. 1.

Molten steel is supplied into the tundish 2 via the immersion nozzle 3 to form the molten steel pool 13 between the casting rolls 1 and 1*a* and the edge dams 4, and the casting rolls 1 and 1*a* are rotated in opposite directions. Molten steel comes into contact with the casting rolls 1 and 1*a* directions toward the centers of the rolls 1 and 1*a* so as to form a solidification cell 11 on surfaces of the rolls 1 and 1*a*. The solidified steel then passes through a roll nip between the casting rolls 1 and 1*a* to form a solidified steel strip 10, see FIG. 1.

Non-oxidizing gas is fed into the internal spaces of the first chambers 60 arranged at both sides of the meniscus shield 5 by the feed pump (not shown) which is connected to the gas inlet ports 61 in the upper portion of the first chambers 60 via the gas feed lines 61, and at the same time, non-oxidizing gas is fed via the gas feed lines 6*a* into the gas knives 6 arranged outside the first chambers 60 so that the space above the molten steel pool 13 maintains a non-oxidizing atmosphere during casting.

In sequence, non-oxidizing gas in the first chambers 60 is fed into the second chambers 80 which have the gas inlet ports 82 in the upper portions communicating with the lower gas outlet ports 64 formed in the undersides of the first chambers 60. Although the internal spaces of the second chambers 80 are respectively divided into three parts, i.e., a central area and lateral areas in the longitudinal direction of the rolls via the partitions 83*a* and 83*b*, non-oxidizing gas is uniformly fed to the areas under the same pressure.

Non-oxidizing gas in the second chambers 80 is injected toward the outer peripheral faces of the casting rolls 1 and 1*a* via the holes 81 which are formed in the inclined lower faces of the second chambers 80, and joins with non-oxidizing gas from the gas knives 6 to form gas-flows reaching the molten steel pool 13 along the outer peripheral faces of the casting rolls 1 and 1*a*.

The metal components such as Mn are successively evaporated from the surface of the molten steel pool 13 into the space under the meniscus shield 10, and a portion of the evaporated components partially mixes with non-oxidizing gas flowing along the outer peripheral faces of the casting rolls 1 and 1*a* to form contaminated gas. Contaminated gas is produced in and then exhausted from first areas A, shown in FIG. 8, between outer faces of the weirs 12 and interfaces of the casting rolls 1 and 1*a* contacting with molten steel, in which the weirs 12 have upper ends detachably mounted on supports 17 via bolts and lower ends immersed into the molten steel pool 13.

A remaining portion of the metal components is created in a second area B, shown in FIG. 8, between the opposed weirs 12 and exhausted to the outside via exhaust ports 5*a* of the meniscus shield 5 corresponding to the second area B.

Since contaminated gas created in the first areas A is upwardly exhausted via the vent holes 85, which are formed in the fixing plates 89 of the supports 71 for fixing the weirs 12 and introduced to the lower gas exhaust ports 65 of the first chambers 60 along the passages S between the meniscus shield 5 and the second chambers 80, it does not stick to the surfaces of the casting rolls 1 and 1*a*.

In succession, since the lower gas exhaust ports 65 are separated from the upper gas inlet ports 61 via the partitions 63, shown in FIG. 7, contaminated gas introduced into the lower gas exhaust ports 65 is outwardly exhausted via the exhaust pump 7 communicating with the gas exhaust lines 62*a* without mixing with clean non-oxidizing gas fed into the upper gas inlet ports 61.

Although exhaustion of contaminated gas as above is carried out basically in a natural fashion, when contaminated gas is created in large quantities, it is also possible to regulate the amount of gas exhausted via the gas exhaustion lines 62*a* by adjusting the sucking force of the exhaust pump 7.

As seen in FIGS. 4 and 6, the first area A between outer faces of the weirs 12 and the boundary surfaces of molten steel has a pressure larger than that of the second area B between the opposite weirs 12 by virtue of the injected non-oxidizing gas being introduced into the area A via the holes 81 so as to prevent contaminated gas from sticking to the outer peripheral faces of the casting rolls 1 and 1*a*. The pressure difference between the first area A and the second area B is preferably set to about 100 mm $H_2O$ or less.

Preferably, in the first areas A, the gas pressure is formed higher in both lateral edge portions than central portions so as to prevent bulging at both edges of the strip.

The above apparatus 1 is applied to a strip caster 100 to cast stainless steel, in which 304 stainless steel is typically in the form of an alloy containing 18 wt % Cr-8 wt % Ni together with about 1 wt % Mn. Mn has a melting temperature of about 1244° C., and evaporates in response to temperature drop to mix with non-oxidizing gas thereby forming contaminated gas. Herein, 100% nitrogen is used as non-oxidizing gas injected into the meniscus shield 5. Of course, other mixed-type non-oxidizing gas can be used also.

When non-oxidizing gas, in particular, nitrogen gas is injected into the meniscus shield 5, a large quantity of evaporated metal components, i.e., Mn gas was produced from the surface of the molten steel pool 13. Evaporated metal components are generally absorbed to the surfaces of the casting rolls 1 and 1*a*, when they are not outwardly exhausted. Thus, casting time is prolonged to influence the qualities of the strip thereby interrupting solidification. However, when the first and second chambers 60 and 80 of the inventive apparatus 1 were applied to both edges of the meniscus shield 5 together with the gas knives 6, it is observed that the quantity of mill scale produced on the surfaces of the casting rolls 1 and 1*a* was remarkably reduced to 20% or less of that observed in the prior art.

Contaminated gas containing the evaporated metal components is exhausted from the first and second areas A and B. The varying pressure in the areas A and B were measured by using a pressure gauge such as a manometer to calculate the pressure difference between the first and second areas A and B. An experiment was made to observe influences of the pressure difference to bulging of the edges of the strip 10, and results thereof are reported in Table 1.

TABLE 1

| Pressure Difference between First and Second Areas (ΔP) (100 mm$H_2O$) | Edge Conditions of Strip (10) |
|---|---|
| 0 | Excellent |
| 50 | Good |
| 100 | Average |
| 150 | Hot Band |
| 200 | Hot Band and Bulging |

Regarding the experiment results, it will be understood that the pressure difference between the first and second areas A and B should be maintained at 100 mm$H_2O$ or less so that the strip 10 can achieve excellent edge conditions.

As set forth above, the present invention adjusts the quantity and pressure of non-oxidizing gas, which is fed into the space under the meniscus shield covering the surface of the molten steel pool between the casting rolls and the edge dams and exhausted therefrom, to protect the casting roll surfaces from sticking of contaminated gas containing mixture of the metal components evaporated from the molten level during casting in the internal atmosphere and non-oxidizing gas thereby reducing the thickness of mill scale on the casting roll surfaces to 20% or less of that in the prior art. As a result, this substantially prevents cracks owing to solidification nonuniformity of the strip surface in the prior art. Furthermore, the invention eliminates non-solidification or bulging of the edges in the strip thereby improving qualities of the strip by large degree.

Although the preferred embodiments of the present invention have been disclosed for illustrative purposes, those skilled in the art will appreciate that various modifications, additions and substitutions can be made without departing from the scope and spirit of the invention as disclosed in the accompanying claims.

The invention claimed is:

1. An apparatus for preventing contamination of roll surface and strip edge bulging in a twin roll strip caster which includes a meniscus shield for interrupting inflow of external air while feeding non-oxidizing gas to prevent oxidation of molten steel in a molten steel pool defined by casting rolls, edge dams and a plurality of weirs mounted under the meniscus shield for preventing mold level fluctuation, the apparatus comprising:

first chambers arranged at both sides of the meniscus shield in a longitudinal direction parallel to the casting roll and having inlet and exhaust ports for respectively feeding and exhausting a non-oxidizing gas to and from the first chambers, said first chambers including means for separating the inlet ports and exhaust ports to provide non-communication therebetween;

second chambers each assembled to an underside in each of the first chambers in a communicating fashion for receiving non-oxidizing gas from the first chambers, and including a plurality of injection holes formed in an inclined face of each of said second chambers, said inclined faces having a shape corresponding to an outer peripheral face in each of the casting rolls in a longitudinal direction of the each casting roll for injecting the non-oxidizing gas to outer peripheral faces of the casting rolls and to portions of the molten steel pool; and exhaust passages formed between the meniscus shield and the second chambers communicating with the gas exhaust ports of the first chambers for allowing contaminated gas containing evaporated metal components from the molten steel pool and non-oxidizing gas injected from the second chambers to be outwardly exhausted.

2. An apparatus for preventing contamination of roll surface and strip edge bulging in a twin roll strip caster in accordance with claim 1, wherein the gas inlet and exhaust ports include:

the upper gas inlet ports which are perforated in upper faces of the first chambers and connected to a gas feed line for feeding the non-oxidizing gas;

the upper gas exhaust ports which are perforated in upper faces of the first chambers connected to a gas exhaust line, wherein the upper gas inlet and exhaust ports are separated in non-communication via a plurality of partitions in the first chambers;

the apparatus further including lower gas outlet ports located in undersides of the first chambers communicating with the upper gas inlet ports; and lower gas exhaust ports located in lateral portions of the first chambers communicating with lateral portions of the meniscus shield and the upper exhaust ports.

3. An apparatus for preventing contamination of roll surface and strip edge bulging in a twin roll strip caster in accordance with claim 2, further comprising filter members located in the upper gas exhaust ports for filtering foreign materials in the contaminated gas which is exhausted via the upper gas exhaust ports.

4. An apparatus for preventing contamination of roll surface and strip edge bulging in a twin roll strip caster in accordance with claim 2, wherein each of the second chambers includes:

a plurality of gas inlet ports perforated in an upper portion thereof communicating with the lower gas outlet ports in each of the first chambers; and two partitions located in a central space of the second chambers for dividing a flow of the non-oxidizing gas, which is injected toward the outer peripheral faces of the casting rolls via the holes in the inclined faces of the second chambers, into a central partial flow and two lateral partial flows.

5. An apparatus for preventing contamination of roll surface and strip edge bulging in a twin roll strip caster in accordance with claim 1, wherein the inclined face in each of the second chambers having the holes is uniformly spaced from the outer peripheral face of each casting roll with a substantially identical curvature with that of the casting roll for readily controlling gas flow.

6. An apparatus for preventing contamination of roll surface and strip edge bulging in a twin roll strip caster in accordance with claim 2, wherein said exhaust passages include spaces between the weirs and the second chambers, and further include vent holes perforated in fixing plates for fixing the second chambers and an exhaust line for communicating with the lower gas exhaust ports of the first chambers.

7. An apparatus for preventing contamination of roll surface and strip edge bulging in a twin roll strip caster in accordance with claim 1, wherein the weirs define first areas between outer faces thereof and molten steel interfaces and communicating with the injection holes of the second chambers to provide a gas pressure in said first area that is larger than that of a second area between the opposed weirs.

8. An apparatus for preventing contamination of roll surface and strip edge bulging in a twin roll strip caster in accordance with claim 7, wherein the first areas and the second area maintain a pressure difference of about 100 mm $H_2O$ or less.

9. An apparatus for preventing contamination of roll surface and strip edge bulging in a twin roll strip caster in accordance with claim 7, wherein the gas pressure of the first areas is higher in lateral edge portions than in central portions by virtue of the closer proximity of the lateral edge portions to the injection holes than the further spaced central portions to prevent bulging in both edges of a strip.

* * * * *

UNITED STATES PATENT AND TRADEMARK OFFICE

CERTIFICATE OF CORRECTION

PATENT NO. : 7,021,364 B2
APPLICATION NO. : 10/489232
DATED : April 4, 2006
INVENTOR(S) : Park et al.

It is certified that error appears in the above-identified patent and that said Letters Patent is hereby corrected as shown below:

Column 3, Line 49, "direction of the each" should read -- direction of each --

Column 3, Line 52, "gas outlet ports" should read -- gas exhaust ports --

Column 5, Line 4, "communicating with to the" should read
-- communicating with the --

Column 5, Lines 39-40, "of the each second chamber 80 in order to divide flow" should read -- of each second chamber 80 in order to divide the flow --

Column 6, Line 14, "1a directions" should read
-- 1a such that heat is extracted in radial directions --

Column 6, Line 16, "on surfaces" should read -- on the surfaces --

Column 6, Line 61, "supports 71" should read -- supports 17 --

Signed and Sealed this

Twenty-second Day of August, 2006

JON W. DUDAS
*Director of the United States Patent and Trademark Office*